United States Patent [19]

Durussel

[11] 4,023,008

[45] May 10, 1977

[54] TERMINAL CONNECTION FOR ELECTRIC HEATERS FOR VEHICLE WINDOWS

[75] Inventor: Philippe Durussel, Reny, France

[73] Assignee: Saint-Gobain Industries, Neuilly-sur-Seine, France

[22] Filed: May 30, 1975

[21] Appl. No.: 582,267

Related U.S. Application Data

[63] Continuation of Ser. No. 428,715, Dec. 27, 1973, abandoned.

[30] Foreign Application Priority Data

Dec. 28, 1972 France ..... 72.46563

[52] U.S. Cl. ..... 219/522; 219/203; 219/543; 339/258 S; 339/275 R

[51] Int. Cl.[2] ..... H05B 3/06

[58] Field of Search ..... 339/9 E, 17 L, 17 LC, 339/256, 258, 275 R, 275 B; 219/203, 522, 543

[56] References Cited

UNITED STATES PATENTS

| | | | |
|---|---|---|---|
| 2,709,211 | 5/1955 | Glynn | 339/252 R |
| 3,422,213 | 1/1969 | Webb | 339/222 |
| 3,534,148 | 10/1970 | Bange | 219/543 |
| 3,634,654 | 1/1972 | Peetz et al. | 219/522 |

FOREIGN PATENTS OR APPLICATIONS

| | | | |
|---|---|---|---|
| 417,397 | 10/1934 | United Kingdom | 339/222 |
| 581,225 | 10/1946 | United Kingdom | |

*Primary Examiner*—Roy Lake
*Assistant Examiner*—Neil Abrams

[57] ABSTRACT

A metallic strap includes two feet soldered to a conductive coating forming part of a heating grid on a glass substrate and, joining those feet, a bridge portion integral with the feet to which a conductor may be affixed for supply of current to the grid. The bridge portion is notched, slotted or perforated to reduce the stresses which differences in thermally induced expansion or contraction between the strap and substrate can impose on the attachment of the strap to the coating.

3 Claims, 4 Drawing Figures

TERMINAL CONNECTION FOR ELECTRIC HEATERS FOR VEHICLE WINDOWS

This is a continuation of application Ser. No. 428,715, filed Dec. 27, 1973, now abandoned.

The present invention pertains to terminals or connectors for heating grids for windows such as those of automobiles, intended to melt ice or to dispel fog from the window. Such heating grids comprise a set of conductors affixed to the glass of the window. There may be a plurality of conductors disposed substantially geometrically parallel to each other on the glass and connected electrically in parallel between two similar but wider conductors, often termed bus bands. The conductors and bus bands may take the form of strips or bands of a conductive metallic powder such as silver mixed with a frit which is baked to the glass, the strips including the bus bands being laid down on the glass as a single electrically continuous pattern by a silk screen process.

The invention pertains more particularly to terminals or connectors for such heating grids, and constitutes an improvement on the construction disclosed in U.S. Pat. No. 3,634,654 assigned to the assignee hereof. One form of terminal, illustrated in FIG. 3 of the drawings of that patent, comprises two spaced feet soldered to the bus band portion of the coating which makes up the heating grid, these feet being part of an integral one piece strap having a bridge portion which joins the feet and which is spaced from the coating. The bridge portion may include or have affixed thereto a tab for the connection of a conductor through which electric current will be fed to or withdrawn from the grid.

The invention is directed to the provision of a connector of this type but having reduced susceptibility to separation of the terminal (and more particularly of its feet) from the heating grid. Such a terminal is typically of small dimensions and low heat capacity, such that when the feet of the terminal are soldered to the grid, the entire terminal is brought to high temperature. The glass of the window has by comparison a large heat capacity, and the glass therefore undergoes very little heating. After the soldering operation is completed the terminal, which is soldered to the bus band at its two spaced feet, tends to contract whereas the glass remains unchanged in dimension. The result is that a terminal of this type as heretofore proposed is subjected to stresses of tension and torsion, and these appear in the glass as well as in the terminal. These stresses may result in separation of one or both feet from the bus band, a defect which is difficult or impossible practically to repair, and which may render valueless a completed automobile windshield of large value.

In accordance with the invention, the terminal is shaped by slots, notches, indentations or perforations in the bridge portion thereof to possess in that bridge portion a region of reduced section. This region of reduced section substantially reduces the risk of detachment of the feet. This results in part from reduction in the rigidity of the bridge portion which joins the feet and, in part, from reduction in the thermal conductivity and heat capacity of the terminal.

The invention will now be further described in terms of a number of presently preferred embodiments and by reference to the accompanying drawings in which.

Figure 1:
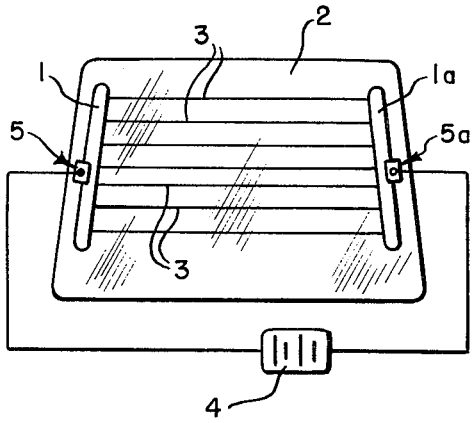
FIG. 1 is a diagrammatic representation of a heating grid incorporating the terminal of the invention.

As shown in FIG. 1 a heating grid of the type to which the invention pertains comprises two bus bands 1 and 1*a* deposited, like the resistance conductors 3 of the heating grid on the glass 2 of a window by a silk screen process and baked to the glass at high temperature. The conductors 3 and bus bands 1 and 2 may, as above indicated, be made of a suspension of silver and of frit particles in an organic binder baked to the glass. While the formation of such heating grids forms no part of the present invention, a process for forming such heating grids is disclosed in British Pat. No. 1,145,367. In the operation of the grid, electric current supplied by a source 4, such as the battery of a motor vehicle, feeds the bus bands 1 and 1*a* through terminals 5 and 5*a*.

Figure 2:
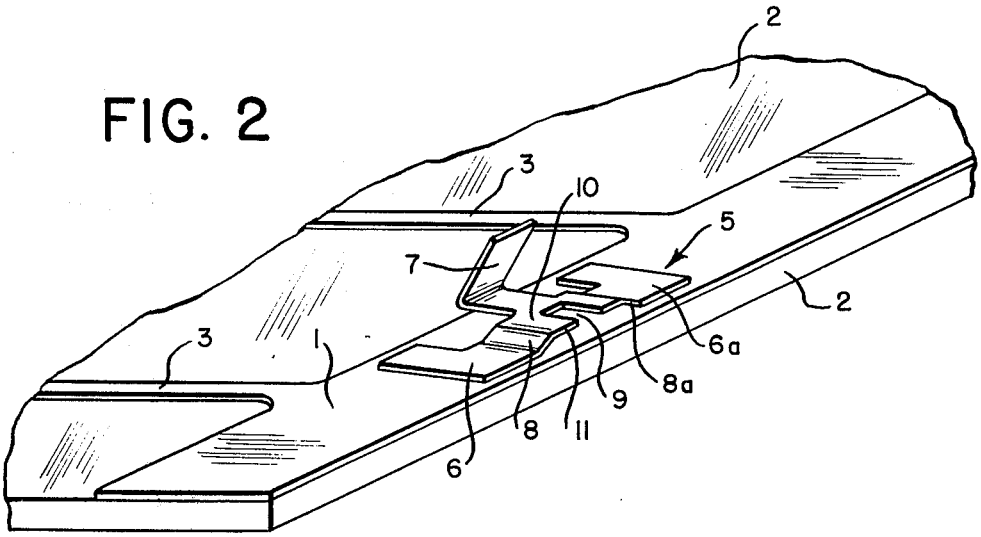
FIG. 2 is a perspective view of a terminal according to the invention.

One of these terminals is shown in detail in FIG. 2. In accordance with the invention this terminal, generally indicated at 5, comprises lateral feet 6 and 6*a* which are soldered to a bus band 1, a bridge portion 11 notched at 9, a tab 7 extending from the bridge portion 11 and initially coplanar therewith, and oblique shoulder portions 8 and 8*a* which may be regarded as part of the bridge and which space the tab and bridge portion 11 from the surface of the bus band 1 to which the feet 6 and 6*a* are soldered. By virtue of the notch 9, continuity of the bridge connecting the feet to the tab is maintained at narrow neck portions 10, which constitute locations of reduced section in the bridge.

By virtue of this construction the terminal possesses elasticity and compliance along the direction between its feet, and the build up of thermal stresses in the terminal and substrate 2 which might otherwise occur upon and after soldering of the feet to the bus band is reduced or eliminated.

Figure 3:
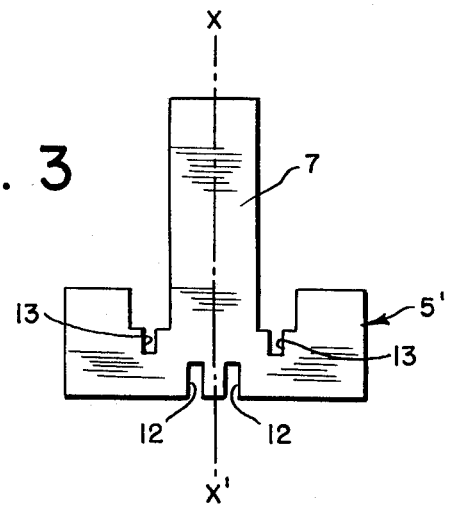
FIGS. 3 and 4 are plan views of variant forms of construction of the terminal according to the invention.
Figure 4:
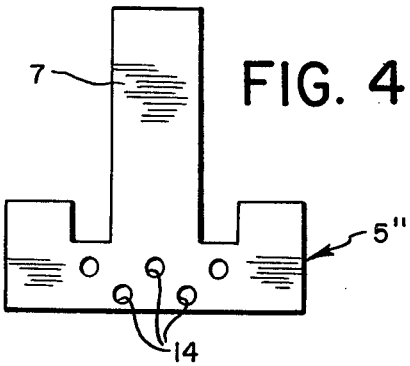

In the embodiment of FIG. 3 notches 12 and 13 symmetrically disposed with respect to the central axis $x$–$x'$ of the terminal give to the bridge portion several regions of reduced section. In the embodiment of FIG. 4 apertures 14 disposed in a staggered array produce a similar effect in the terminal 5'' of that figure.

In each of FIGS. 3 and 4 the tab 7 is shown prior to bending back of the end thereof as illustrated in FIG. 2.

While the invention has been described hereinabove in terms of a number of presently preferred embodiments thereof, the invention itself is not limited thereto but rather comprehends all modifications of and departures from those embodiments properly falling within the scope of the appended claims.

I claim:

1. A terminal of a heater grid including conductive strips and bus bands made of a mixture of metallic powder and a frit baked to a rigid insulating support, said terminal comprising two coplanar feet soldered to one of said bus bands, and a strip-shaped bridge portion joined with the feet by shoulder portions and displaced from the plane of said feet, a tab extending laterally from said bridge portion between said shoulder portions with the initial portion of the tab coplanar with the bridge portion, the bridge portion directly between said shoulder portions and in direct lateral alignment with said initial portion of the tab having an opening passing completely therethrough to produce in said bridge portion a region of smaller lateral cross section than other regions of said bridge portion.

2. A terminal according to claim 1 wherein said bridge portion directly between said shoulder portions and in alignment with said initial portion of the tab is notched in said region thereof on the side opposite said initial portion of the tab to reduce the lateral cross section thereof with respect to the lateral cross section of the remainder of said bridge portion.

3. A window comprising a rigid transparent insulating sheet, a heater grid including conductive strips and bus bands made of a mixture of metallic powder and a frit baked onto a surface of the sheet, and at least one terminal for connection of the grid into an electric circuit, the terminal including two coplanar feet soldered to one of said bus bands, and a strip-shaped bridge portion joined with the feet by shoulder portions and displaced from the plane of said feet, a tab extending laterally from said bridge portion between said shoulder portions with the initial portion of the tab coplanar with the bridge portion, the bridge portion directly between said shoulder portions and in direct lateral alignment with said initial portion of the tab having an opening passing completely therethrough to produce in said bridge portion a region of smaller lateral cross section than other regions of said bridge portion.

* * * * *